US005727928A

United States Patent [19]

Brown

[11] Patent Number: 5,727,928

[45] Date of Patent: Mar. 17, 1998

[54] FAN SPEED MONITORING SYSTEM FOR DETERMINING THE SPEED OF A PWM FAN

[75] Inventor: Alan E. Brown, Georgetown, Tex.

[73] Assignee: Dell USA L.P., Austin, Tex.

[21] Appl. No.: 572,435

[22] Filed: Dec. 14, 1995

[51] Int. Cl.[6] ..... F04B 49/06

[52] U.S. Cl. ..... 417/44.11; 361/23; 361/695; 361/687

[58] Field of Search ..... 417/12, 42, 44.11, 417/45, 53; 318/434, 799; 361/23, 695, 687; 388/903; 395/750; 340/648

[56] References Cited

U.S. PATENT DOCUMENTS

| | | | |
|---|---|---|---|
| 4,977,375 | 12/1990 | Toth | 324/511 |
| 5,099,181 | 3/1992 | Cannon | 318/254 |
| 5,436,827 | 7/1995 | Gunn et al. | 364/695 |
| 5,448,143 | 9/1995 | Pecone | 318/434 |
| 5,469,320 | 11/1995 | Walker et al. | 361/33 |
| 5,513,361 | 4/1996 | Young | 395/750 |
| 5,534,854 | 7/1996 | Bradbury et al. | 340/648 |

*Primary Examiner*—Timothy Thorpe

*Assistant Examiner*—Xuan M. Thai

*Attorney, Agent, or Firm*—Stanford & Bennett

[57] ABSTRACT

A fan speed monitoring system for interfacing a fan, including a fan drive and sensing circuit for maintaining the voltage of the fan's TFSC pin above a minimum voltage level, thus maintaining continuous power to the fan. The fan drive and sensing circuit includes a control loop having an isolation resistor for enabling superposition of fan pulses asserted by the fan on the TFSC pin. The fan speed monitoring system also includes a filter circuit for filtering and amplifying the fan pulses and providing corresponding filtered pulse signals. The fan drive and sensing circuit includes an active control loop for maintaining the voltage of the TFSC pin at an average level above the minimum voltage level, while also enabling inclusion of the fan pulses. The filter circuit preferably includes an AC amplifier for amplifying the fan pulses and a level transition comparator for converting the amplified fan pulses to the filtered pulse signals having the desired form. In the preferred embodiment, a control circuit activates the fan drive and sensing circuit and receives the filtered pulse signals for determining a time value indicative of the speed of the fan. The control circuit converts the time value into a revolution per minute (RPM) value for identifying fan speed.

26 Claims, 4 Drawing Sheets

FAN SPEED MONITORING SYSTEM FOR DETERMINING THE SPEED OF A PWM FAN

FIELD OF THE INVENTION

The present invention relates to cooling fans, and more particularly to a method and apparatus for determining the speed of a PWM fan for early detection of fan failure and potential thermal runaway.

DESCRIPTION OF THE RELATED ART

Thermal management for electronic systems, including personal computers (PCs), is a challenging task especially when a greater number of components with increased speed and capability are jammed into smaller packages. Physics dictates that such new and improved components often produce a greater amount of heat than their predecessors. For example, the latest microprocessor from Intel, referred to as the P6 or Pentium Pro, generates at least 35 watts of heat, which is greater than the amount of heat generated by the Pentium processor.

Since the chassis of a new system is often the same size as or even smaller than that of prior systems, the efficiency of the thermal management techniques must be improved. Designers of PCs often attempt to develop a more efficient design using the same chassis ventilation methods used in the prior systems. For example, the power supply exhaust fan is often expected to provide most or all of the forced air cooling for newer computer systems, even those based on the new P6 processor. Because of the relatively large heat load generated by the newer devices, such as the P6, it is desired to continually monitor the system's status as well as the operation of thermal management devices to predict impending thermal runaway. For example, since the P6 generates a significant amount of heat, it has a relatively high potential of causing a fast thermal runaway condition in the event of fan failure.

It is desired to monitor the status of the cooling fan, therefore, for preventing thermal runaway in the event of malfunction. If the fan has failed or is operating at an undesirable low speed, it is desired to initiate a controlled automatic shutdown as soon as practicable to avoid thermal runaway. Many new fan systems, however, include a pulse-width modulated (PWM) driven fan receiving power from a PWM power signal. The speed of the fan is determined by the duty cycle of the PWM power signal, so that the power provided to the fan is not continuous. Controlling the power to the fan using PWM techniques provides improved control over the operation of the fan by ensuring that the correct energy is provided to maintain the desired rotational speed and cooling level of the fan. Pulse width modulating the fan's power source, however, effectively disables the ability to monitor the fan's internal tachometer for determining fan speed. In particular, many fans, including PWM driven fans, include an internal tachometer, which asserts fan pulses indicative of fan "poles" during rotation. However, the tachometer only operates where power is applied to the fan. If the fan is operating at a relatively low speed or otherwise receiving power at a low percentage of each PWM cycle, there are not enough fan pulses to determine the fan's speed.

In an average computer using a PWM driven fan, for example, the fan conduction time is less than fifty per cent. Such low percentage of on-time reduced the number of pulses so that the RPM could not be accurately determined.

What is needed is a means for determining the speed of the fan for determining actual failure, or for otherwise predicting impending failure of a PWM driven fan. Such determination could be used, for example, to provide an early warning of impending thermal malfunction and to initiate a controlled automatic shut-down of the PC system.

SUMMARY OF THE PRESENT INVENTION

A fan speed monitoring system according to the present invention interfaces a fan unit including a thermal fan speed control (TFSC) pin for controlling a pulse width modulated (PWM) driven fan. The fan speed monitoring system includes a fan drive and sensing circuit for maintaining the voltage of the TFSC pin above a minimum voltage level, thus maintaining continuous power to the fan. The fan drive and sensing circuit preferably includes an isolation resistor, so that fan pulses asserted by an internal tachometer within the fan unit itself are superimposed on the TFSC pin. The fan speed monitoring system also includes a filter circuit for filtering and amplifying the fan pulses and providing corresponding filtered pulse signals indicative of the speed of the fan. The filtered pulse signals are preferably a predetermined logic level, such as according to transistor-transistor logic (TTL) or the like.

In the preferred embodiment, the fan drive and sensing circuit includes a bias circuit for providing a bias signal having a voltage above the minimum voltage level required to maintain the continuous power to the fan. Also, the fan drive and sensing circuit includes an active control loop having a buffer and an amplifier. The control loop receives the bias signal and maintains the voltage of the TFSC pin above the minimum level, while also enabling inclusion of the fan pulses. The isolation resistor is provided within the control loop for enabling superposition of the fan pulses within the loop. The filter circuit preferably includes an AC amplifier for amplifying the fan pulses and a level transition comparator for converting the amplified fan pulses to the filtered pulse signals having the desired form.

Also in the preferred embodiment, a control circuit activates the fan drive and sensing circuit and receives the filtered pulse signals for determining a time value indicative of the speed of the fan. Since the fan is preferably a four-pole, DC brushless fan, the time value is preferably a time duration of five consecutive pulses, indicative of one full rotation of the fan. The first pulse is ignored since it could be a false blanking pulse from the internal tachometer of the fan. The control circuit converts the time value into a revolution per minute (RPM) value for identifying fan speed. If the fan has failed and is not spinning, or is otherwise operating at a lower speed than necessary to maintain the desired cooling level, the control circuit asserts a warning signal to the system being cooled by the fan. The system can then initiate a controlled shutdown sequence and warn the user if desired.

In this manner, a fan speed measurement system according to the present invention enables determination of the instantaneous speed of a PWM driven fan having a TFSC bidirectional pin and internal tachometer. A system according to the present invention, therefore, enables prediction of an imminent thermal runaway condition in the event of fan failure.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1:
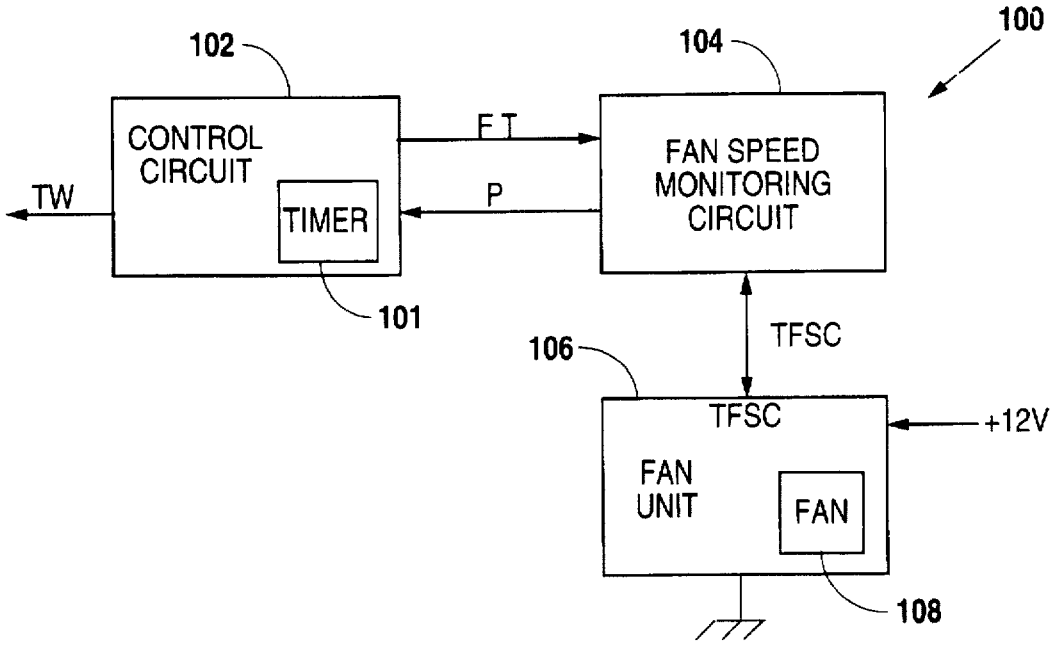
FIG. 1 is a block diagram illustrating a fan speed monitoring and control system according to the present invention.

Referring now to FIG. 1, a block diagram is shown illustrating a fan speed monitoring and control system 100 according to the present invention A control circuit 102 asserts a fan test signal, referred to as FT, to a fan speed monitoring circuit 104, which tests and monitors the speed of a fan 108 within a fan unit 106. In response to the FT signal, the fan speed monitoring circuit 104 asserts filtered pulse signals to the control circuit 102 on a signal P, where such filtered pulse signals are indicative of the speed of the fan 108. These filtered pulses may be in any desired form, but are preferably converted to transistor-transistor logic (TTL) level pulses for detection by the control circuit 102. The control circuit 102 includes a timer 101 or similar timing device for measuring the time duration between consecutive pulses on the P signal. Such timer 101 could be a discrete component or incorporated within a larger control device. For example, the control circuit 102 is preferably part of a larger system, which includes a microprocessor or microcontroller or the like for detecting the pulses on the P signal and for determining the speed of the fan 108. The system could be any type of electronic device, such as a personal computer (PC) or any type of computer system cooled by a fan.

The fan 108 is preferably a twelve-volt, DC brushless fan having four magnetic poles. The fan 108 is also preferably a pulse-width modulated (PWM) driven fan having a thermal fan speed control (TFSC) bidirectional input/output pin, which is coupled to the fan speed monitoring circuit 104. In particular, the TFSC pin may be driven to a particular voltage level to override the internal circuitry of the fan unit 106 for controlling the power to the fan 108, which thus changes the speed of the fan 108. A twelve volt power signal, referred to as +12V, is provided to the fan unit 106 for providing power to the fan 108. Preferably, the TFSC pin is externally driven between approximately 0.9 to 2.5 volts (V), where an asserted voltage of 0.9V or less causes little or no effect on fan speed whereas a voltage of 2.5V or more causes the fan unit 106 to apply continuous power to the fan 108. The longer the power is applied to the fan 108 during each cycle, the faster it rotates. Full power applied continuously eventually causes the fan 100 to operate at full speed.

Within the fan unit 106, a comparator circuit (not shown) compares a triangular sawtooth waveform (see, e.g., FIGS. 5, 6) with the voltages of both the TFSC pin and an internal thermistor mounted to a heatsink. The comparator circuit asserts power to the fan 108 during each portion of the cycle that the voltage of the triangular sawtooth waveform is below the voltage levels of both of the TFSC and thermistor voltages. The sawtooth waveform preferably oscillates at 30 Hertz (Hz) between 0.9 and 2.5V. The comparator circuit performs a "wired-OR" function so that whichever input between the thermistor and the TFSC pin requests a higher speed by asserting a higher voltage controls the speed of the fan 108. Thus, the triangular sawtooth waveform establishes a fixed-frequency, variable duty cycle PWM signal based on the TFSC pin and the thermistor, for varying the amount of time that power is provided to the fan 108 during each cycle. For example, if the TFSC pin is asserted at 1.5V and the thermistor circuit asserts a voltage of 2V, then the thermistor controls the fan's speed. Power is applied to the fan 108 for about two-thirds of each cycle until the voltage of the sawtooth waveform reaches 2V, at which time power is removed for the remaining portion of the cycle.

The fan unit 106 includes an integral tachometer circuit (represented as an amplifier 330 in FIG. 3), which asserts output pulses on the TFSC pin indicative of the speed of the fan 108. The fan pulses are preferably about 0.5V in magnitude and about 1 millisecond (ms) in duration, and are caused by the armature of the fan 108 passing the magnetic "poles" of the fan's magnet. In the preferred embodiment, the fan 108 is a DC brushless fan having four magnetic poles, one for every 90 degrees of rotation. Thus, five consecutive pulses represents one full revolution of the fan armature and blades. In general, the speed of the fan 108, measured in revolutions per minute (RPM), is determined by measuring the elapsed time ($T_{360}$) Of five consecutive pulses, and plugging the measured value $T_{360}$ into the following equation (1):

$$1/T_{360}\times 60=\text{RPM} \quad (1)$$

Although, less than five pulses could be measured and the equation adjusted for measuring the speed based on less than one full rotation, this provides a less accurate determination of fan speed.

In the particular embodiment shown, the speed of the fan 108 preferably varies up to a full speed of approximately 2,400 RPM, although fans with various speeds are contemplated. If the fan 108 is commanded to spin at a particular speed and the actual speed measured is significantly less, or if the fan 108 is not spinning at all, then fan failure is determined and the system being cooled by the fan 108 is automatically shutdown to prevent a thermal runaway condition. Thus, the control circuit 102 continuously, or, at least, periodically measures the speed of the fan 108 for determining the fan's status. The control circuit 102 asserts a thermal warning signal TW to the system if fan speed is inadequate, thereby indicating impending thermal runaway. The system may respondingly initiate a controlled shutdown sequence and inform a user of the impending thermal failure.

Although the speed calculation described above appears relatively straightforward, the fan 108 is a PWM-driven fan where the fan unit 106 asserts fan pulses on the TFSC pin indicative of the poles of the fan 108 only while power is being applied to the fan 108. Furthermore, each time power is initially applied to the fan 108, which is usually at the beginning of each PWM cycle, a false blanking pulse is asserted on the TFSC pin. An accurate measurement could be made if six consecutive pulses were provided during one cycle, where the first pulse may be a false pulse and thus is ignored. However, even when the fan 108 is operating at its full speed of 2,400 RPM, a full revolution takes approximately 25 ms, where a 30 Hz cycle only allows about 33 ms. The fan 108 would have to be spinning at least about 2,200–2,300 RPM to assert five pulses in one cycle, and then only if the power was being applied during most, if not all, of that cycle. Such conditions can not be guaranteed and may not occur at all, especially if the fan 108 is operating at significantly less than full speed. In typical operations, the fan conduction time is less than fifty per cent, thereby preventing direct fan speed measurement. The fan speed monitoring circuit 104 according to the present invention overcomes these deficiencies.

Figure 2:
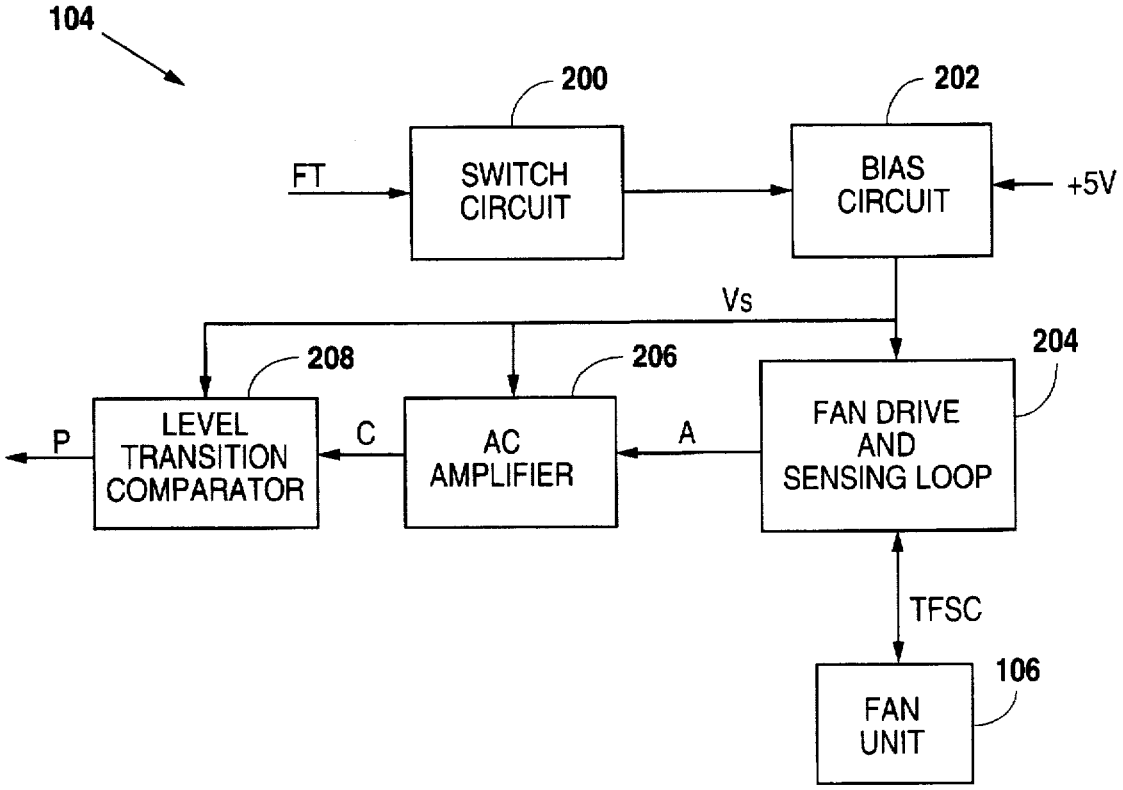
FIG. 2 is a more detailed block diagram of the fan speed monitoring circuit of FIG. 1.

Referring now to FIG. 2, a more detailed block diagram is shown of the fan speed monitoring circuit 104 of FIG. 1. The FT signal is provided to a controllable switch circuit 200, which could include an open-collector inverter, a discrete NPN bipolar transistor, an open-drain CMOS gate or transistor, a MOSFET, or any similar type of controllable switch that responds to the FT signal. The switch circuit 200 activates a bias circuit 202, which receives a five volt supply signal, referred to as +5V, and provides a bias voltage $V_s$ to a fan drive and sensing loop 204, an AC amplifier 206 and a level transition comparator 208. The fan drive and sensing loop 204 is coupled to the TFSC pin of the fan unit 106 for controlling and monitoring the fan 108, and the level transition comparator 208 asserts filtered pulse signals on the P signal indicative of the speed of the fan 108. The AC amplifier 206 and the level transition comparator 208 generally perform filtering functions for detecting and filtering the fan pulses.

The $V_s$ signal is preferably a DC voltage greater than the minimum DC voltage for ensuring that power is maintained to the fan 108 if applied on the TFSC pin. In the embodiment shown, the minimum voltage is 2.5V, so that the voltage of the $V_s$ signal is greater than 2.5V. The fan drive and sensing loop 204 receives the $V_s$ signal and applies an average voltage approximately equal to the voltage of the $V_s$ signal on the TFSC pin of the fan unit 106. The fan unit 106 correspondingly applies and maintains power to the fan 108 while the switch circuit 200 is activated. The tachometer of the fan unit 106 correspondingly asserts pulses on the TFSC pin indicative of fan poles of the fan 108. Thus, the fan drive and sensing loop 204 combines the pulses and the $V_s$ signal while maintaining the average voltage equal to the voltage of the $V_s$ signal on the TFSC pin of the fan unit 106. The fan pulses are effectively superimposed on the $V_s$ signal and applied to the TFSC pin. In this manner, the voltage of the $V_s$ signal is chosen so that the fan drive and sensing loop 204 keeps the lowest voltage of the TFSC pin above 2.5V, even when the pulses from the fan unit 106 are combined. This ensures that power to the fan 108 is maintained, which thereby ensures that the fan unit 106 continually asserts pulses on the TFSC pin.

The fan drive and sensing loop 204 buffers the voltage of the TFSC pin for developing a signal A, which is provided to the AC amplifier 206. The AC amplifier 206 is biased at the $V_s$ level and amplifies the fan pulses detected on the A signal for asserting amplified pulses on a signal C, which is provided to the level transition comparator 208. The level transition comparator 208 uses the $V_s$ bias signal to detect the amplified pulses on the C signal and converts the pulses to a predetermined logic level. The level transition comparator 208 also asserts the filtered logic pulses on the P signal corresponding to the fan poles asserted by the fan unit 106. In the preferred embodiment, the level transition comparator 208 is designed to assert TTL level pulses on the P signal, based on five-volt logic. Of course, any particular logic level may be used depending upon the control circuit 102. The control circuit 102 detects the logic pulse signals and uses the timer 101 or other timing means for determining a time value indicative of the speed of the fan 108. In the preferred embodiment, the time value is preferably the elapsed time between five consecutive pulses.

In this manner, the control circuit 102 asserts the FT signal and monitors pulses on the P signal for determining the speed of the fan 108. It is noted that the assertion of the voltage of the TFSC pin eventually has the effect of increasing the speed of the fan 108, if the fan 108 is not already operating at full speed. However, the fan speed test need only be performed for a very short period of time, so that the speed of the fan 108 is not increased to any appreciable degree before the test is completed. Since only five pulses are needed and since the first pulse is ignored, only the first six pulses appearing on the P signal are necessary to determine the speed of the fan 108 during operation.

The test need only be performed for the time to complete six pulses if it is desired not to change the speed of the fan 108. A voltage requesting full speed applied on the TFSC pin for only a duration of six pulses has negligible effect on the fan speed, even for relatively low fan speeds. It is noted, however, that there is little or no negative effect on applying the voltage tier a longer period of time even if the speed of the fan 108 is increased. The first six pulses enable measurement of the instantaneous operating speed of the fan 108, so that applying the voltage for a longer period of time has no effect on the accuracy of the measurement.

Figure 3:
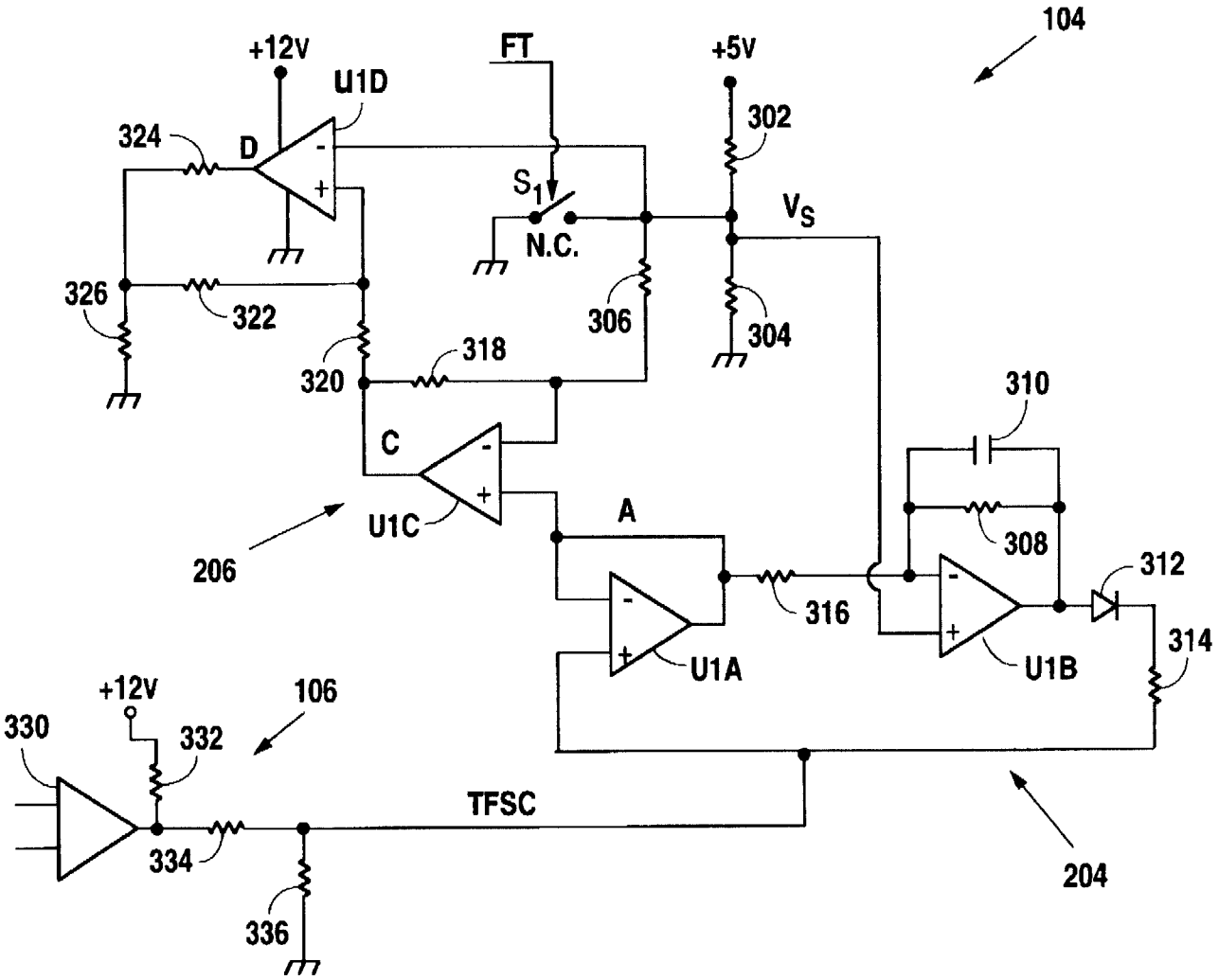
FIG. 3 is a detailed schematic diagram of the fan speed monitoring circuit of FIG. 1.

Referring now to FIG. 3, a detailed schematic diagram is shown of the fan speed monitoring circuit 104 of FIG. 1. The FT signal is provided to the control input of a normally closed switch S1, having one terminal coupled to ground and another terminal receiving the $V_s$ signal, which is connected to the inverting input of a comparator U1D and to one end of each of three resistors 302, 304 and 306. The other end of the resistor 302 receives the +5V signal and the other end of the resistor 304 is coupled to ground, so that the resistors 302 and 304 form a voltage divider of the +5V five volt signal, for determining the voltage level of the $V_s$ signal. In the preferred embodiment, the resistors 302 and 304 are 2KΩ and 2.4KΩ, respectively, for establishing the voltage of the $V_s$ signal to approximately 2.73V.

The $V_s$ signal is provided to the non-inverting input of an amplifier U1B, having its inverting input connected to one end of a feedback resistor 308, to one end of a lead compensation capacitor 310 and to one end of an isolation resistor 316. The other ends of the capacitor 310 and the resistor 308 are connected to the output of the amplifier U1B, which is also connected to the anode of an optional diode 312. The resistors 308 and 316 preferably establish a relatively high gain for the amplifier U1B, where these resistors are preferably 300KΩ and 10KΩ, respectively, for a gain of about 30. The cathode of the diode 312 is connected to one end of an isolation resistor 314, having its other end connected to the TFSC pin of the fan unit 106 and to the non-inverting input of a buffer U1A. The isolation resistor 314 is preferably about 51KΩ. The output of the buffer U1A asserts the A signal, which is provided to the inverting input of the buffer U1A, to the other end of the resistor 316 and to the non-inverting input of an amplifier U1C. The loop circuit formed by the amplifier U1B and the buffer U1A perform the functions of the fan drive and sensing loop 204. The capacitor 310 provides stability for the loop and for the output of the amplifier U1B. The diode 312 is optional and preferably prevents current flow through the resistor 314 when the switch S1 is closed.

The inverting input of the amplifier U1C is connected to the other end of the resistor 306 and to one end of another feedback resistor 318. The other end of the resistor 318 is connected to the output of the amplifier U1C, which asserts the C signal, and which is connected to one end of an isolation resistor 320. The isolation resistor 320 is preferably 2KΩ. The circuit of the amplifier U1C performs the functions of the AC amplifier 206. The other end of the resistor 320 is connected to the non-inverting input of the comparator U1D and to one end of a hysteresis resistor 322. The resistor 322 is preferably about 100KΩ. The other end of the resistor 322 is the P signal, which is provided to one end of a resistor 324 and to one end of a resistor 326. The output of the comparator U1D, referred to as a signal D, is provided to the other end of the resistor 324. The circuit of the comparator U1D performs the functions of the level transition comparator 208. The resistor 318 is preferably about 51KΩ, and the resistors 324 and 326 divide the output of the comparator U1D to a TTL compatible voltage level.

In the preferred embodiment, the output of the comparator U1D swings between 0 and 12V, where the resistors 324 and 326 are preferably 2.4KΩ and 2KΩ, respectively, for dividing the voltage of the output of the comparator U1D to a TTL range of between 0 and 5V. The amplifiers U1B, U1C, the buffer U1A and the comparator U1D are preferably operational amplifiers (op amps), and which are preferably provided in a single package, such as the LM324 Quad Op-Amp or the like.

The fan unit 106 preferably includes an integral amplifier 330 representing the internal tachometer circuit, having its output provided to one end of a pullup resistor 332 and to one end of a resistor 334. The other end of the pullup resistor 332 receives the +12V signal, and the other end of the resistor 334 is coupled to the TFSC pin and to one end of a resistor 336. The other end of the resistor 336 is connected to ground. If the resistance of the resistor 336 is represented as RX, then the resistance of the resistor 334 is about 20RX for dividing the voltage of twelve volt fan pulses asserted by the amplifier 330 to about 0.5V during normal operation. For example, the resistors 334 and 336 may be 2.2MΩ and 100KΩ, respectively. However, since the values of the resistors 334, 336 may change from one fan unit to the next, the op amps U1A and U1B form an active loop for maintaining the TFSC pin at an average of 2.73V when determining the speed of the fan 108, as described more fully below.

Figure 4:
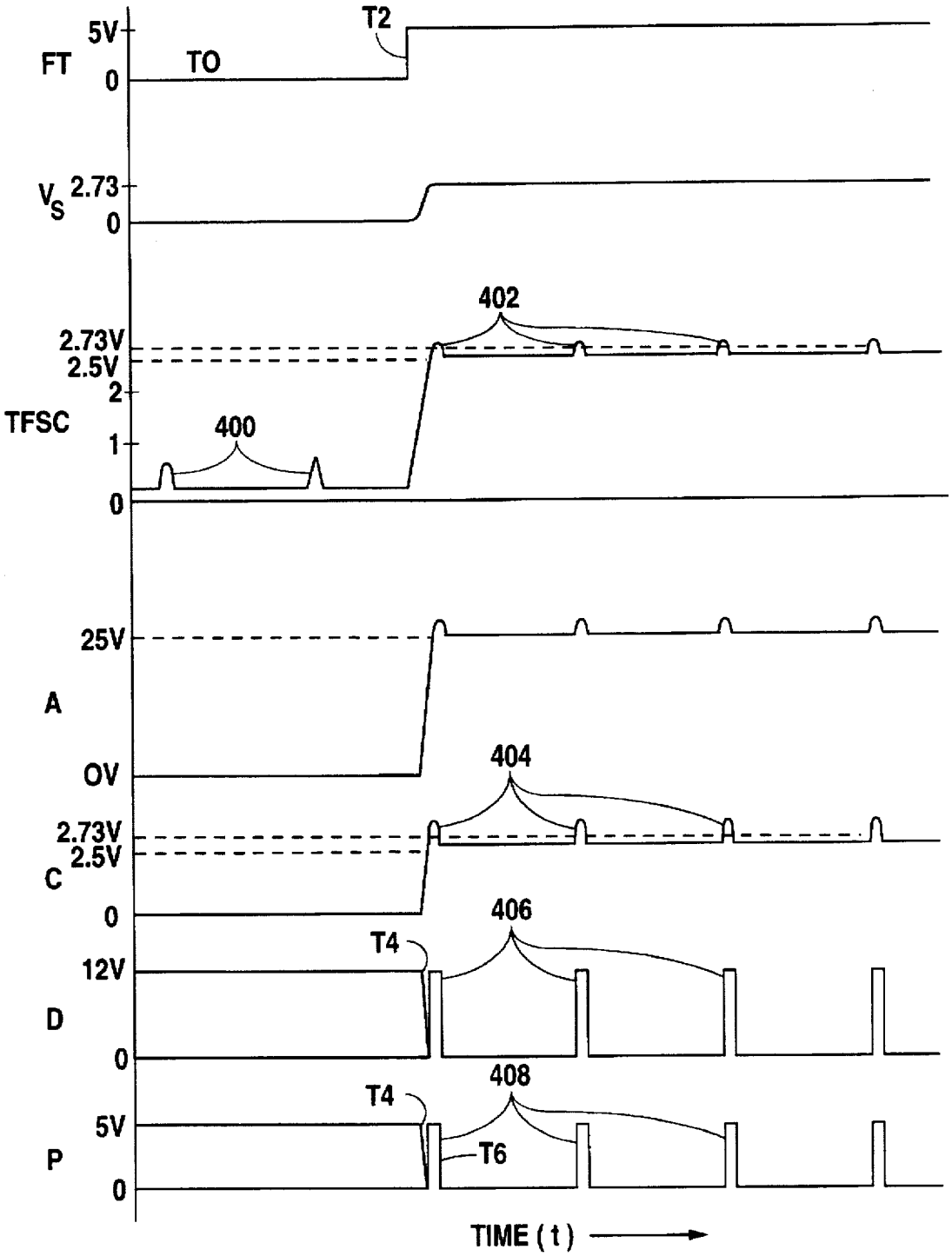
FIG. 4 is a timing diagram illustrating operation of the fan speed monitoring circuit of FIG. 3.

Operation of the fan speed monitoring circuit 104 of FIG. 3 is now described with reference to the timing diagram shown in FIG. 4, where signals FT, $V_s$, TFSC (representing the voltage of the TFSC pin), A, C, D and P are plotted versus time (t). At an initial time T0, the FT signal is initially low so that the switch S1 is closed grounding the $V_s$ signal. The loop formed by the op amps U1A and U1B is initially off and does not effect the normal operation of the TFSC signal. The diode 312 preferably prevents current through the resistor 314. Thus, the TFSC signal is asserted to any particular DC level asserted by an external driver (not shown), with 0.5V fan pulses 400 indicative of fan poles while power is provided to the fan 108. The fan 108 is operating at a relatively slow speed, such as about 1,100 RPM, so that not enough information is provided on the TFSC pin for measuring the speed of the fan 108. The A and C signals are initially 0V and the D and P signals are asserted to 12V and 5V, respectively.

Subsequently at about a time T2, the control circuit 102 asserts the FT signal high to open the switch S1, which releases the $V_s$ signal. The $V_s$ signal rises to approximately 2.73V, and the comparator U1D asserts its output low in response at a time T4. The control loop formed by the buffer U1A and amplifier U1B operates to maintain the average voltage of TFSC to about 2.73V. This includes the fan pulses asserted by the amplifier 330 of the fan unit 106. However, the magnitude of subsequent pulses 402 asserted by the fan unit 106 are reduced by approximately two-thirds on the TFSC pin, or to a magnitude of about 170–180 mV, since the resistor 314 is effectively placed in parallel with the resistor 336. Nonetheless, the lowest voltage maintained on the TFSC pin by the op amps U1A and U1B is still above 2.5V since 2.73–180 mV>2.5V. Thus, the power to the fan 108 is continuously maintained while the switch S1 is opened. Further, the TFSC signal oscillates with the poles of the fan 108 above and below 2.73V, since the average voltage is maintained at 2.73V by the loop formed by the amplifier U1B and the buffer U1A. In this manner, the fan pulses are superimposed on the $V_s$ signal at the TFSC pin. The buffer U1A acts as a voltage follower or unity gain buffer, so that the A signal follows the TFSC signal while the switch S1 is open.

The amplifier U1C is also biased at the 2.73V level from the $V_s$ signal and therefore maintains its output at an average DC level of about 2.73V after time T4. However, since the pulses 402 representing the AC content of the A signal falls below and rises above the 2.73V level, the pulses are amplified by a factor of about six, being the gain of the amplifier U1C, to a magnitude of approximately 1V. In this manner, the C signal still averages about 2.73V, but with amplified pulses 404, which are greater than those asserted on the A signal. The lowest absolute voltage level of the C signal at the valleys of the pulses 404, and the highest absolute voltage level, at the peaks of the voltage pulses 404, depends upon the number of pulses indicative of the speed of the fan 108. Nonetheless, these absolute voltages are below and above, respectively, the voltage of the $V_s$ signal, or 2.73V, due to averaging. The comparator U1D effectively compares the C signal with the $V_s$ signal, which, again, is at 2.73V. The comparator U1D asserts the D signal high to 12V for each pulse 404 and otherwise deasserts its output to 0V. The resistors 324, 326 divide the 12V pulses 406 to the TTL or 5V level for the P signal. Thus, the pulses 402 on the TFSC pin representing the poles of the fan 108 are converted to TTL level pulses 408 between 0 and 5V on the P signal. Since the pulses provided from the fan unit 108 are not necessarily square, the resistor 322 provides a hysteresis function for squaring the pulses 406 and 408.

It is appreciated that the circuitry of the op amps U1C and U1D, therefore, perform filtering functions for detecting fan pulses provided by the fan unit 106. The fan pulses are converted to filtered pulses having a desired form for detection and measurement.

In summary, the control circuit 102 asserts the FT signal high and monitors the pulses 408 on the P signal for measuring the speed of the fan 108. The very first pulse asserted at time T6 is ignored since it may represent a false blanking pulse. The first pulse is false if the fan 108 was not receiving power when the TFSC signal was asserted above 2.5V in response to the $V_s$ signal being asserted. Of course, if the fan 108 was receiving power when the TFSC signal is asserted above 2.5V, the first pulse would not be false. It is ignored in either case. The next five consecutive pulses asserted on the P signal represent a full rotation of the blades and armature of the fan 108. Thus, the control circuit 102 monitors the first six pulses on the P signal, measures the time delay $T_{360}$ between the last five of the six pulses and determines the RPM speed of the fan using equation (1) above.

Figure 5:
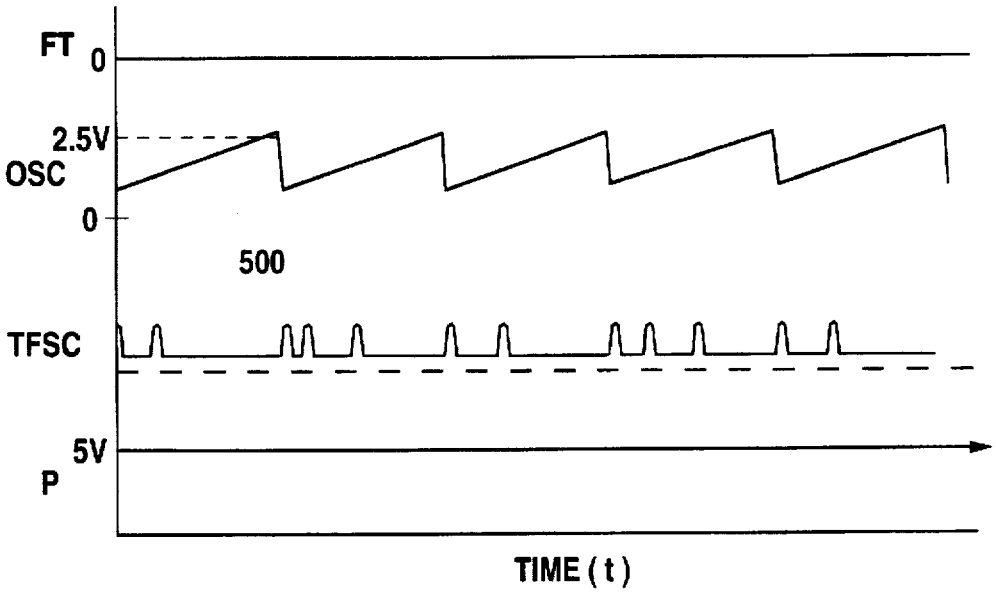
FIG. 5 is a timing diagram illustrating normal operation of the fan when the fan speed monitoring circuit is turned off.

FIG. 5 is a timing diagram illustrating normal operation of the fan 108 at a speed of about 1,100 RPM while the switch S1 is closed to turn off the fan speed monitoring circuit 104. A signal OSC is the triangular sawtooth waveform oscillating at 30 Hz between 0.9 and 2.5V within the fan unit 106 as described previously. Power is applied to the fan 108 each time the voltage of the OSC signal falls below either the thermistor voltages or the TFSC signal. A few pulses 500 appear on the TFSC signal at the beginning of each cycle. The P signal remains high indicating that the fan speed monitoring circuit 104 is off. The pulses 500 are asserted by the internal tachometer only as long as power is applied to the fan 108, where power is removed when the OSC signal rises above the voltage of both the TFSC signal and the internal thermistor. Assuming that the external devices and the thermistor are not requesting higher speed of the fan, the power is applied to the fan 108 for a relatively short duration for each cycle. Also, the first pulse in each series is a false pulse and must be ignored. Since only two or three pulses 500 appear on the TFSC pin during each cycle, it is clear that not enough information is available to accurately measure the speed of the fan 108.

Figure 6:
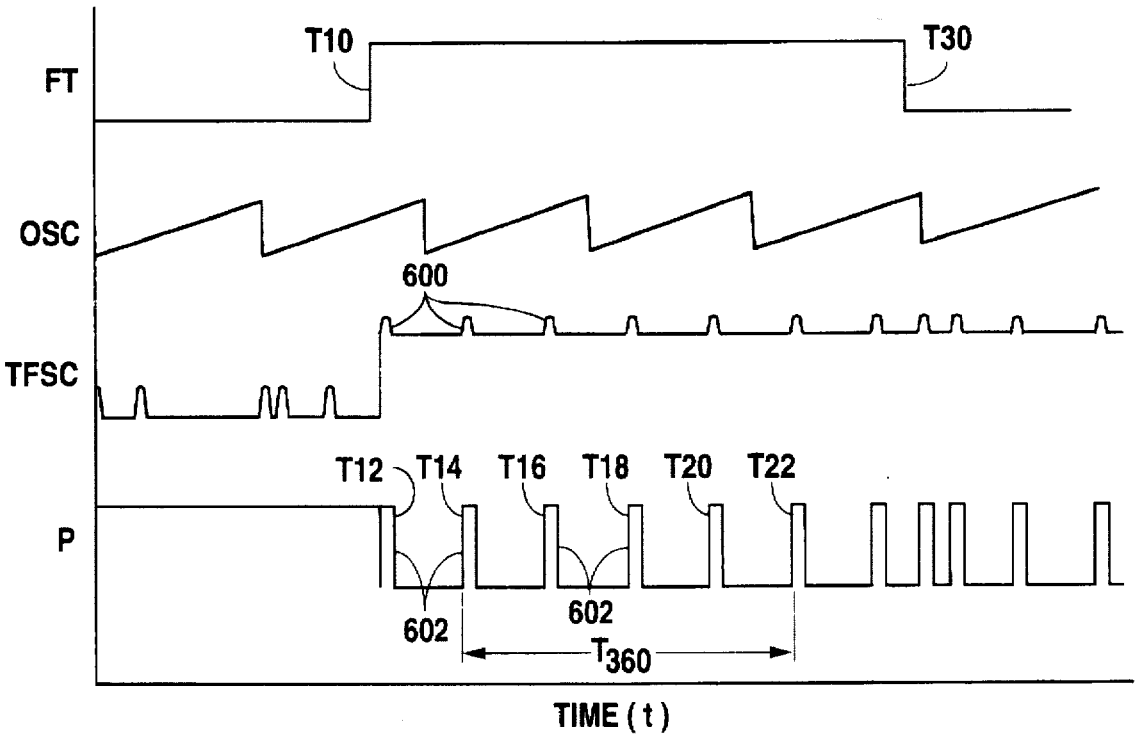
FIG. 6 is a timing diagram illustrating operation of the fan when the fan speed monitoring circuit is turned on to measure the speed of the fan.

FIG. 6 is a timing diagram illustrating operation of the fan 108 at the same speed of about 1,100 RPM when the switch S1 is opened at a time T10 to turn on the fan speed monitoring circuit 104. Prior to a time T10, operation is the same as that shown in FIG. 5. After time T10, however, power is continuously applied to the fan 108 so that a stream of pulses 600 appear on the TFSC pin. Corresponding pulses 602 appear on the P signal. The first pulse at time T12 on the P signal is ignored since it may be a false pulse. The next five pulses at times T14, T16, T18, T20 and T22 are then used to measure a time value $T_{360}$ indicative of the speed of the fan 108. The FT signal is then deasserted low at a time T30 and the fan speed monitoring circuit 104 is turned off. The fan 108 continues to operate in normal fashion.

It is noted that the TFSC pin may be asserted above 2.5V for a very short period of time, so that any corresponding increase in the speed of the fan 108 is negligible. It is noted, however, that if the FT signal remained asserted, the fan 108 would increase its speed to its maximum value since effectively being requested to do so by the fan speed monitoring circuit 104 through the TFSC pin. Nonetheless, this still would not effect the speed measurement since it is retrieved at the very beginning of the request.

It is now appreciated that a fan speed monitoring system according to the present invention enables the determination of the speed of a PWM-driven fan having a thermal an speed control terminal or pin. The fan speed monitoring system includes a fan sensing and control loop which maintains power to the fan and also senses pulses asserted by the fan on the fan thermal speed control pin. A filter circuit filters the fan pulses to a desired form for detection and measurement. In particular, the pulses are amplified and converted to measurable pulses for detection by a control circuit. The control circuit initiates the test by activating the fan speed monitoring system, and then monitors the pulses at its output. The first pulse is ignored and the following five pulses are timed for providing a time value indicative of fan speed. The control circuit determines if fan speed is adequate, and if not, asserts a warning signal to the system.

Although a system and method according to the present invention has been described in connection with a preferred embodiment, the present invention is not intended to be limited to the specific form set forth herein, but on the contrary, it is intended to cover such alternatives, modifications, and equivalents, as can be reasonably included within the spirit and scope of the invention as defined by the appended claims.

I claim:

1. A fan speed monitoring system for interfacing a fan unit, the fan unit including a fan speed control terminal for controlling a pulse width modulated (PWM) driven fan and the fan unit asserting fan pulses on the fan speed control terminal indicative of fan poles during the power portion of each PWM cycle, the fan speed monitoring system comprising:

a fan drive and sensing circuit for maintaining the voltage of the fan speed control terminal above a minimum level to maintain continuous power to the fan while also superimposing fan pulses asserted by the fan unit; and a filter circuit coupled to said fan sensing circuit for amplifying and filtering said fan pulses and for providing corresponding filtered pulse signals.

2. The fan speed monitoring system of claim 1, wherein said fan drive and sensing circuit includes a bias circuit for providing a bias signal above said minimum level.

3. The fan speed monitoring system of claim 2, wherein said bias circuit comprises a resistive voltage divider receiving a reference voltage for providing said bias signal.

4. The fan speed monitoring system of claim 1, wherein said fan drive and sensing circuit includes an active control loop for maintaining the voltage of the fan speed control terminal at an average voltage having a minimum voltage equal to or greater than said minimum level, wherein the fan pulses asserted by the fan unit are superimposed on the voltage of the fan speed control terminal, so that said fan pulses oscillate above and below said average voltage.

5. The fan speed monitoring system of claim 4, wherein said control loop comprises:

an amplifier having first and second inputs and an output, wherein said first input receives a bias signal equal to said average voltage and said output is for coupling to and controlling the voltage of the fan speed control terminal; and a buffer having an input for coupling to the fan speed control terminal and an output coupled to said second input of said amplifier.

6. The fan speed monitoring system of claim 5, further comprising:

an resistive isolation device for coupling between the output of said amplifier and the fan speed control terminal.

7. The fan speed monitoring system of claim 5, further comprising:

said buffer providing a buffered version of the voltage of the fan speed control terminal; and said filter circuit including an AC amplifier for amplifying said fan pulses.

8. The fan speed monitoring system of claim 7, wherein said AC amplifier amplifies said fan pulses while maintaining an average voltage approximately equivalent to the voltage of said bias signal.

9. The fan speed monitoring system of claim 7, wherein said filter circuit further comprises:

a level transition comparator coupled to said AC amplifier for converting amplified fan pulses to said filtered pulse signals having a predetermined logic level.

10. The fan speed monitoring system of claim 9, wherein said predetermined logic level is transistor-transistor logic.

11. The fan speed monitoring system of claim 9, wherein said level transition comparator includes a comparator for comparing said bias signal with said amplified fan pulses for providing said filtered pulse signals.

12. The fan speed monitoring system of claim 11, wherein said buffer, amplifier, AC amplifier and comparator each include an operational amplifier from a single quad operational amplifier integrated circuit.

13. The fan speed monitoring system of claim 1, further comprising:

a control circuit for activating said fan drive and sensing circuit and said filter circuit and for receiving said filtered pulse signals.

14. The fan speed monitoring system of claim 13, wherein said control circuit includes:

a controllable switch for turning on and off the fan speed monitoring system.

15. The fan speed monitoring system of claim 14, further comprising:

a bias circuit for providing a bias signal having a voltage level greater than said minimum level; and wherein said switch grounds said bias signal when said switch is closed and enables said bias circuit and the fan speed monitoring system when said switch is open.

16. The fan speed monitoring system of claim 13, wherein said control circuit determines a time value from said filtered pulse signals for determining the speed of the fan.

17. The fan speed monitoring system of claim 16, wherein the fan is a four pole fan, and wherein said time value is a time duration of five consecutive pulses indicative of one full rotation of the fan.

18. A fan speed measurement system for a pulse width modulated (PWM) driven fan having a bidirectional thermal fan speed control pin, comprising:

a bias circuit for providing a bias signal having a voltage level greater than a minimum voltage level necessary for maintaining continuous power to the fan;

a fan drive and sensing circuit receiving said bias signal for maintaining the voltage of the thermal fan speed control pin above said minimum level while also superimposing fan pulses asserted by the fan;

filter circuit coupled a filter circuit coupled to said fan drive and sensing circuit for filtering and amplifying said fan pulses and for providing corresponding filtered pulse signals indicative of the speed of the fan; and a control circuit for activating said bias circuit and for receiving said filtered pulse signals for determining a time value indicative of the speed of the fan.

19. The fan speed measurement system of claim 18, wherein said fan drive and sensing circuit comprises:

a first operational amplifier implemented as an amplifier having first and second inputs and an output, wherein said first input receives said bias signal and said output is for coupling to and controlling the voltage of the fan thermal speed control pin;

an isolation resistor for coupling between said output of said first operational amplifier and the fan thermal speed control pin; and a second operational amplifier implemented as a buffer having an input for coupling to the fan thermal speed control pin and an output coupled to said second input of said first operational amplifier.

20. The fan speed measurement system of claim 18, wherein said control circuit asserts a thermal warning signal indicative of an impending thermal runaway condition if said time value indicates inadequate speed of the fan.

21. A method of monitoring the speed of a pulse width modulated (PWM) driven fan, the fan provided in a fan unit including a fan speed control terminal for controlling the fan and for asserting fan pulses on the fan speed control terminal indicative of fan poles during the power portion of each PWM cycle, the method comprising the steps of:

maintaining the voltage of the fan speed control terminal above a minimum level to maintain continuous power to the fan while also superimposing fan pulses asserted by the fan unit; and amplifying and filtering said fan pulses and for providing corresponding filtered pulse signals.

22. The method of claim 21, wherein said amplifying and filtering step includes the step of:

isolating the fan speed control terminal for enabling sensing of the fan pulses.

23. The method of claim 21, wherein said step of maintaining the voltage of the fan speed control terminal above a minimum level further comprises the step of:

maintaining the voltage of the fan speed control terminal at an average voltage having a minimum voltage equal to or greater than said minimum level, wherein the fan pulses asserted by the fan unit are superimposed on the voltage of the fan speed control terminal, so that said fan pulses oscillate above and below said average voltage.

24. The method of claim 23, further comprising the steps of:

receiving a bias signal equal to said average voltage; and amplifying said fan pulses while maintaining an average voltage approximately equivalent to the voltage of said bias signal.

25. The method of claim 24, further comprising the step of:

comparing said bias signal with said amplified fan pulses to provide said filtered pulse signals.

26. The method of claim 21, further comprising the step of:

determining a time value from said filtered pulse signals for determining the speed of the fan.

* * * * *